US010281106B2

(12) United States Patent
Svettini et al.

(10) Patent No.: US 10,281,106 B2
(45) Date of Patent: May 7, 2019

(54) LIGHTING AND/OR SIGNALLING DEVICE FOR VEHICLES

(71) Applicant: AUTOMOTIVE LIGHTING ITALIA S.p.A. A SOCIO UNICO, Turin (IT)

(72) Inventors: Marco Svettini, Turin (IT); Sara Paroni, Turin (IT)

(73) Assignee: Automotive Lighting Italia S.p.A. a Socio Unico, Turin (IT)

( * ) Notice: Subject to any disclaimer, the term of this patent is extended or adjusted under 35 U.S.C. 154(b) by 699 days.

(21) Appl. No.: 14/577,267

(22) Filed: Dec. 19, 2014

(65) Prior Publication Data

US 2015/0176790 A1 Jun. 25, 2015

(30) Foreign Application Priority Data

Dec. 20, 2013 (IT) ..... PD2013A0353

(51) Int. Cl.
*F21V 7/04* (2006.01)
*F21S 43/00* (2018.01)
(Continued)

(52) U.S. Cl.
CPC ..... *F21S 43/00* (2018.01); *F21S 43/14* (2018.01); *F21S 43/239* (2018.01);
(Continued)

(58) Field of Classification Search
CPC .. F21S 8/10; F21S 48/00; F21S 48/215; F21S 48/2206; F21S 48/2218; F21S 48/2243; F21S 48/2268
(Continued)

(56) References Cited

U.S. PATENT DOCUMENTS 5,634,708 A 6/1997 Koie et al.
5,711,592 A * 1/1998 Hotta ..... B60Q 1/302 359/15
(Continued)

FOREIGN PATENT DOCUMENTS

DE 35 42 292 A1 7/1986
DE 10 2011 055 430 A1 5/2013
(Continued)

OTHER PUBLICATIONS

Jun. 26, 2014 European Search Report for Italian Patent Application No. PD20130353.

*Primary Examiner* — Andrew J Coughlin
*Assistant Examiner* — Meghan K Ulanday
(74) *Attorney, Agent, or Firm* — Howard & Howard Attorneys PLLC

(57) ABSTRACT

A lighting and/or signalling device includes a container body having containment seats housing at least one light source for emitting light. A lenticular body closes the containment seats and is suitable to receive the beam of light and propagate it. A first lighting portion diffuses light of a predefined color, delimited by a first optic filter, having a first color different from the predefined color. Each light source is inside the containment seat and receives the beam of light, propagates it along a light guide body and emits it across the lenticular body. A second optic filter has a second color. The light produced by each light source and filtered by the second and by the first optic filter comes out of the lenticular body having the predefined color. The first optic filters are the same color so as to prove substantially indistinguishable when the respective light sources are deactivated.

14 Claims, 4 Drawing Sheets

(51) Int. Cl.

| | |
|---|---|
| ***F21S 43/14*** | (2018.01) |
| ***F21S 43/27*** | (2018.01) |
| ***F21S 43/20*** | (2018.01) |
| ***F21S 43/239*** | (2018.01) |
| ***F21S 43/245*** | (2018.01) |
| *F21W 107/00* | (2018.01) |

(52) U.S. Cl.
CPC ..... *F21S 43/245* (2018.01); *F21S 43/255* (2018.01); *F21S 43/27* (2018.01); *F21W 2107/00* (2018.01)

(58) Field of Classification Search
USPC ..... 362/606
See application file for complete search history.

(56) References Cited

U.S. PATENT DOCUMENTS

| | | | | |
|---|---|---|---|---|
| 6,955,459 | B2 * | 10/2005 | Mochizuki ..... | F21S 48/215 362/511 |
| 2012/0113659 | A1 | 5/2012 | Hermitte et al. | |

FOREIGN PATENT DOCUMENTS

| | | | |
|---|---|---|---|
| EP | 2 527 722 | A1 | 11/2012 |
| EP | 2 604 914 | A2 | 6/2013 |
| GB | 2 196 729 | A | 5/1988 |
| WO | 2004/052682 | A1 | 6/2004 |

* cited by examiner

LIGHTING AND/OR SIGNALLING DEVICE FOR VEHICLES

BACKGROUND OF THE INVENTION

1. Field of Invention

The present invention relates to a lighting and/or signalling device for vehicles, such as for example a vehicle light and the like.

2. Description of the Related Art

The term vehicle light is understood to mean indifferently a rear vehicle light or a front vehicle light, the latter also known as a headlight.

As is known, a vehicle light is a lighting and/or signalling device of a vehicle including at least one external vehicle light having a lighting and/or signalling function towards the outside of the vehicle such as for example a sidelight, an indicator light, a brake light, a rear fog light, a reverse light, a dipped beam headlight, a main beam headlight and the like.

For the purposes of the present invention however, the term lighting and/or signalling device is taken to mean not just a vehicle light as described above but also further lighting and/or signalling devices, such as map lights and the like.

Consequently, within the sphere of the present invention lighting and/or signalling device for vehicles is taken to mean a lighting and/or signalling device of a vehicle including at least one light having a lighting and/or signalling function.

In the description which follows however, reference will be made to a vehicle light without by so doing losing its general application.

The lighting and/or signalling device, in its simplest form includes a container body, a lenticular body and at least one light source.

The lenticular body is placed so as to close a mouth of the container body so as to form a housing chamber. The light source is arranged inside the housing chamber, which may be directed so as to emit light towards the lenticular body, when powered with electricity.

As is known, vehicle lights should include at least one signalling/lighting device which serves for example for the rear and/or lateral sidelight, brake light, indicator light, reverse light functions.

Usually, the lights which should perform these different functions should provide for precise and different colours, imposed by government-mandated regulations.

SUMMARY OF THE INVENTION

The prior solutions thus have the drawback of evidently modifying the aesthetic appearance of the light, i.e. of the lenticular body, even when this is not lit, i.e. when the internal light source is not powered.

In other words, the light has portions of lenticular body having different colours at the portions of light used for example as indicator lights, sidelights, brake lights, reverse lights.

The alternation of portions of lenticular body having different colours also changes considerably the overall aesthetic appearance of the light which, in addition to performing the lighting/signalling function, is often regarded as a highly distinctive design element for the whole vehicle.

In order to limit at least partially the use of portions of lenticular body of different colours and thereby harmonize as much as possible the appearance of the light, it is known of in the lighting field to use "subtractive mixing' techniques.

In practice a sequences of filters is used, typically two, to emit light in the desired final colour, through a portion of lenticular body the same or not too dissimilar from adjacent portions of lenticular body used for different signalling/lighting functions.

In other words, between the light source and the portion of the lenticular body used for the signalling/lighting function at least one intermediate filter having a different colour from that of the lenticular body is positioned; the light emitted by the light source is thus filtered both by the intermediate filter and by the portion of the lenticular body, and by subtractive mixing, the light of the desired colour is obtained in output from the vehicle light; depending on the final colour to be obtained, a portion of lenticular body having an identical colour or not too dissimilar from adjacent portions of the lenticular body may be used.

As shown, the colours of the lights are obtained through the use of optical filters combined with the light source wherein, for example, the lenticular body can act as a first optical filter facing a second optical filter.

However such optical filters are generally located downstream of an optical system which includes them, along a vehicle axis oriented towards an outside observer. It follows that the optical filters can generate an undesired colour stimulus, when the light source is turned off.

This way the observer has the perception of the presence of various optical components of the light used for the lighting/signalling functions mentioned such as side lights, brake lights, indicator lights, reverse lights. The overall aesthetics of the vehicle light are thus modified. Solutions having above cited drawbacks are known from WO 2004/052682 A1 and EP 2604914 A2.

The need is thus felt to make a vehicle light which makes it possible to emit lights of different colours in order to perform the various lighting/signalling functions of the light, when it is on, i.e. when the lights are powered, and which, at the same time, does not invalidate the aesthetic appearance of the light when not in use (i.e. lights off).

The present invention overcomes the deficiencies in the related art in a lighting and/or signalling device including a container body having a plurality of containment seats. Each containment seat houses at least one light source electrically connected by electrical connection to power the same. The light source is suitable for emitting a beam of light to propagate to the outside of the lighting and/or signalling device. A lenticular body is positioned so as to close the plurality of containment seats and is suitable to receive the beam of light produced by each light source and to propagate it toward the outside of the lighting and/or signalling device, at least in a longitudinal direction of propagation of the beam of light. Each containment seat of the lenticular body includes a first lighting portion that acts to diffuse a beam of light of a predefined colour, delimited by a first optic filter having a first colour different from the predefined colour. Each light source is positioned inside the containment seat in a position rearward of the lenticular body, in a longitudinal direction of propagation of the beam of light. Moreover, each light source faces a light guide. The light guide includes a light input wall which receives the beam of light produced by the light source, propagates it along a light guide body and emits it from a light output wall, facing the lenticular body so that the beam of light crosses the lenticular body. In addition, a second optic filter is positioned between each light source and the input light wall. The second optic filter includes a second colour different from the first colour of the first optic filter so that the beam of light produced by each light source and filtered by the second and by the first optic filter in succession comes out of the lenticular body having the predefined colour. The first optic filters of adjacent portions of the lenticular body are the same colour so as to prove substantially indistinguishable when the respective light sources are deactivated.

Other embodiments of the lighting and/or signalling device as set forth in the invention are described in the subsequent claims.

BRIEF DESCRIPTION OF THE DRAWINGS

Further characteristics and advantages of the present invention will be more clearly comprehensible from the description given below of its embodiments, wherein.

The elements or parts of elements common to the embodiments described below will be indicated using the same reference numerals.

DETAILED DESCRIPTION OF THE INVENTION

Figure 1:
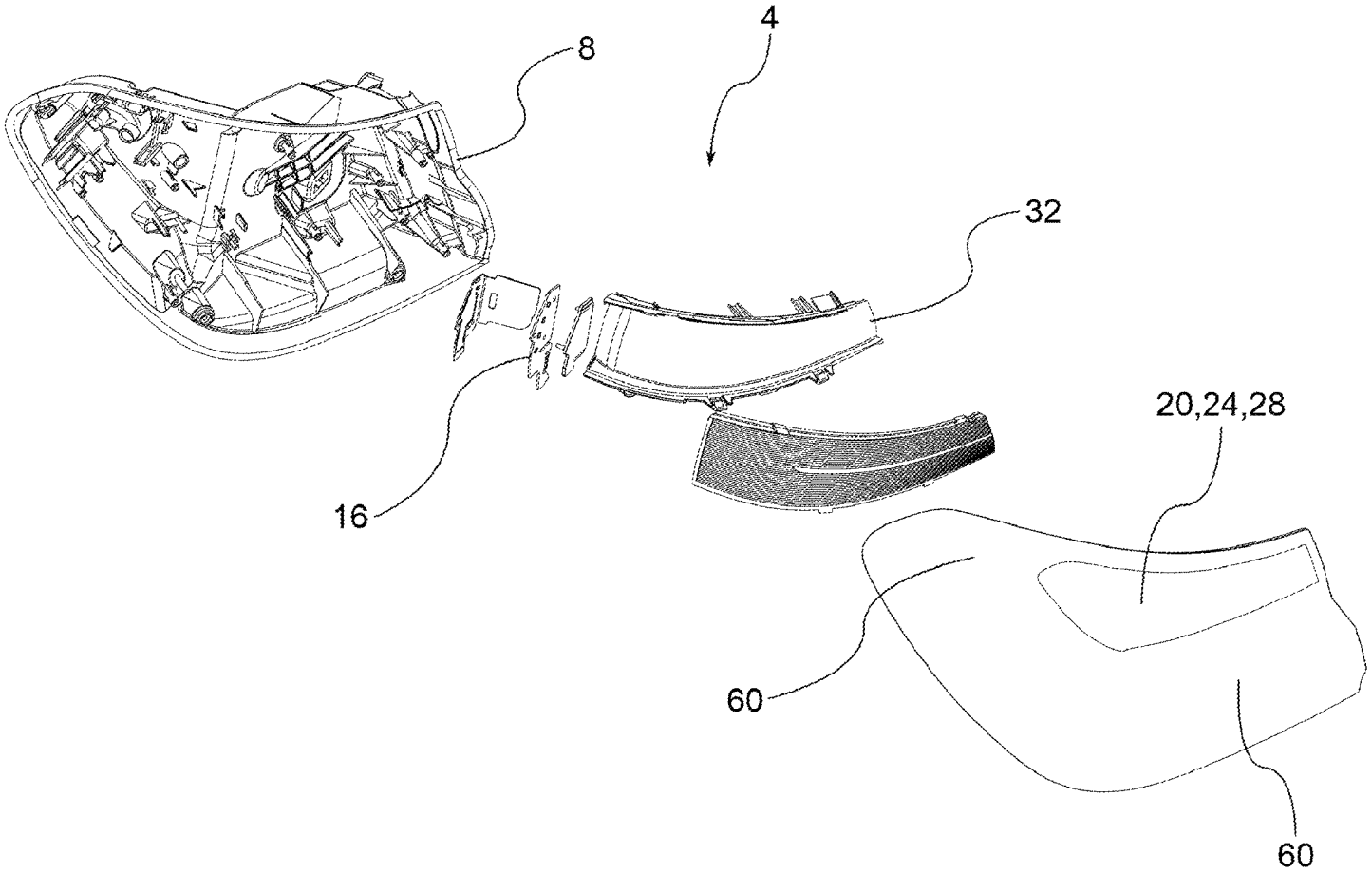
FIG. 1 shows a perspective view, in separate parts, of a lighting and/or signalling device as set forth in one embodiment of the present invention.
Figure 2:
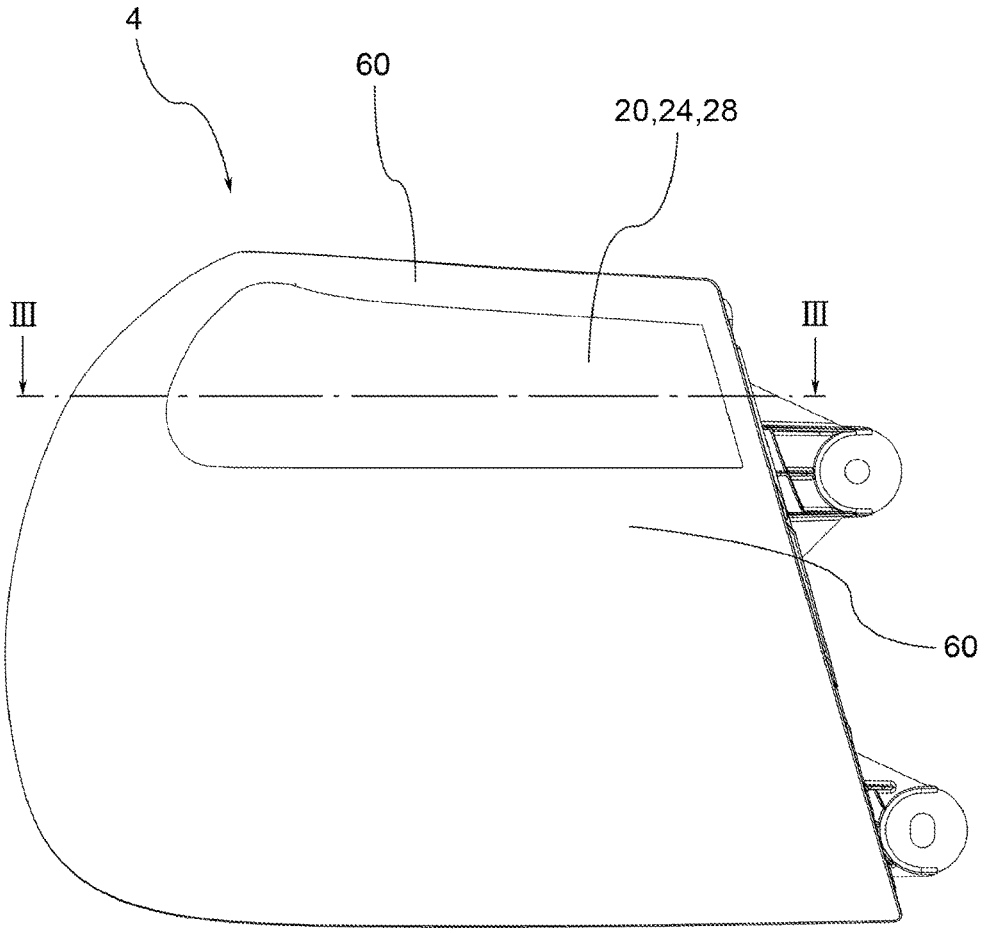
FIG. 2 shows a front view, in an assembled configuration, of the lighting and/or signalling device in FIG. 1.
Figure 3:
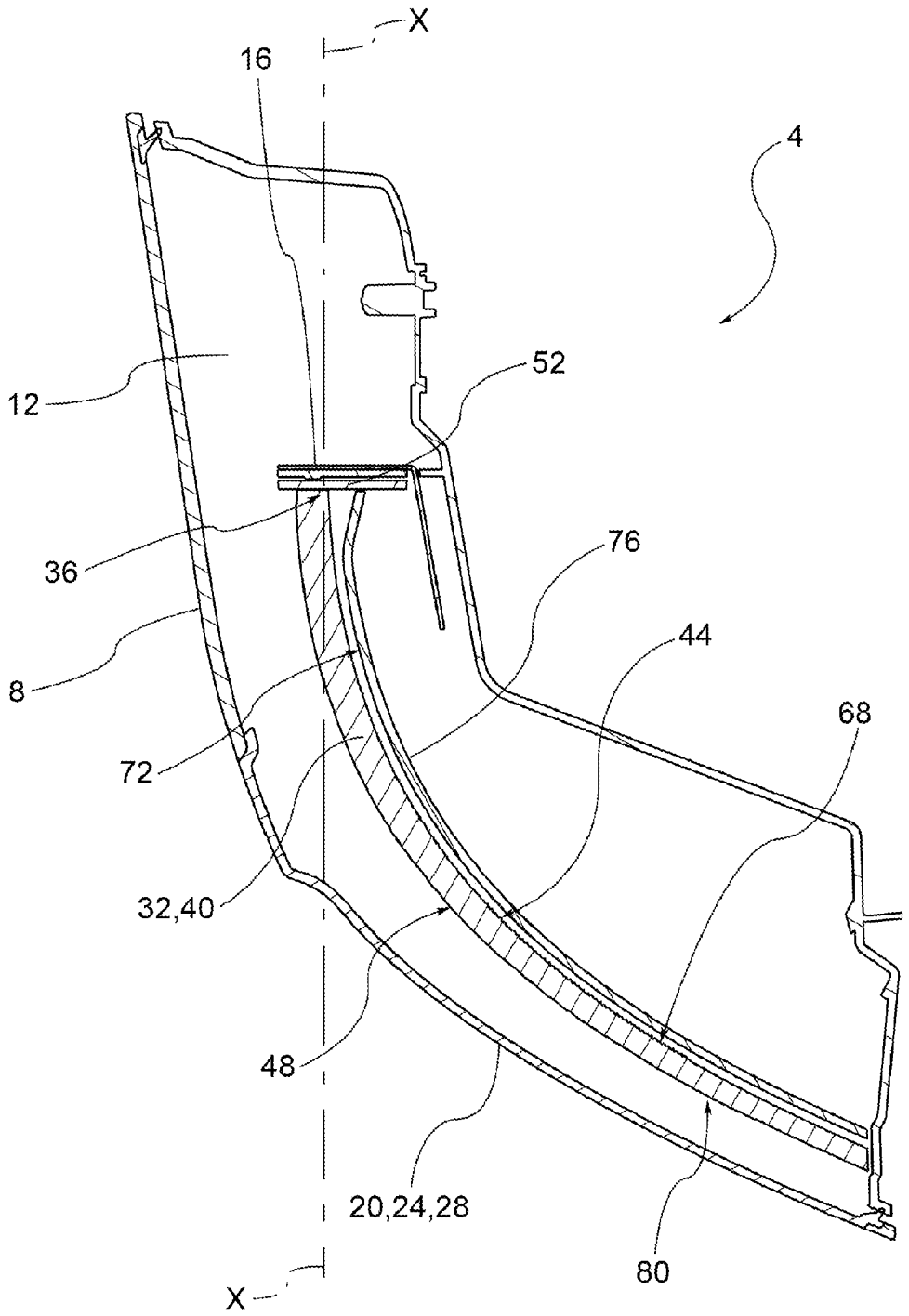
FIG. 3 shows a cross-section view of the lighting and/or signalling device in FIG. 1, along the cross-section plane III-III in FIG. 2.
Figure 4:
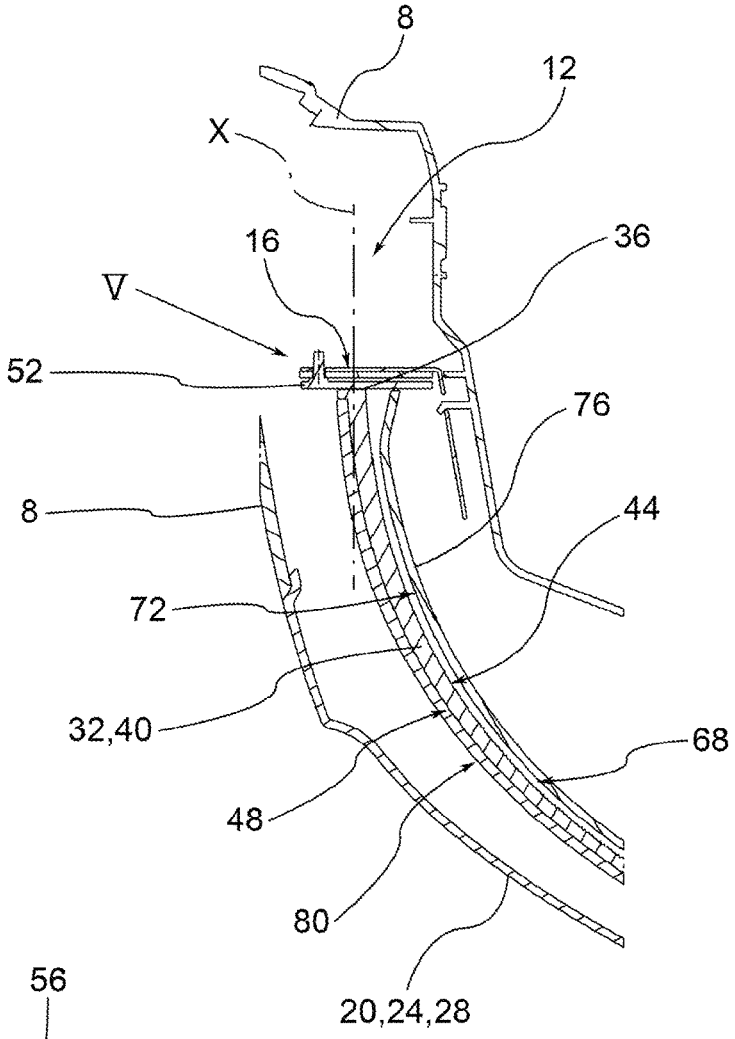
FIG. 4 shows a cross-section view of the lighting and/or signalling device in FIG. 1, along the cross-section plane III-III in FIG. 2, as set forth in a further embodiment of the present invention.
Figure 5:
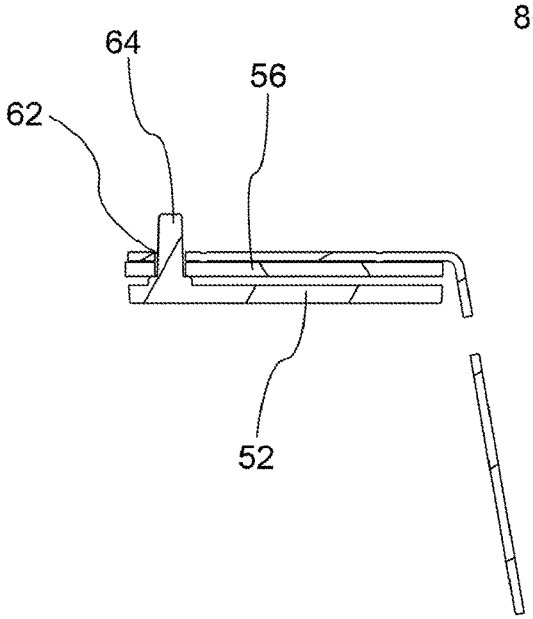
FIG. 5 shows a cross-section view of the enlarged detail V in FIG. 4.

With reference to the aforementioned figures, reference numeral 4 globally denotes a lighting and/or signalling device for vehicles, such as a vehicle light, which the description which follows refers to without by so doing losing its general application.

As mentioned above, the term vehicle light is understood to mean indifferently a rear vehicle light or a front vehicle light, the latter also known as a headlight. As known the vehicle light includes at least one outer light of the vehicle having a lighting and/or signalling function, such as for example a sidelight, which may be a front, rear or lateral sidelight, an indicator light, a brake light, a rear fog light, a dipped beam headlight, a main beam headlight and the like.

However, it is understood that in the context of the present invention a lighting and/or signalling device for vehicles is generally understood as a lighting and/or signalling device of a vehicle including at least one vehicle light having a lighting or signalling function.

Furthermore, the definition of lighting and/or signalling device of the vehicle type should also be understood in the generic sense, including a lighting device and/or signalling device suitable to be used on any type of vehicle for locomotion.

The lighting and/or signalling device 4 includes a container body 8, usually of polymeric material, which allows the attachment of the lighting and/or signalling 4 device to the relative vehicle.

The container body 8 delimits a containment seat 12 which houses at least one light source 16, electrically connected by electrical connection to power the same, and suitable for emitting a beam of light to propagate to the outside of the lighting and/or signalling device 4. For the purposes of the present invention it is possible to use different types of light sources 16; advantageously, the light source is a light source of light emitting diodes (LED).

The lighting and/or signalling device 4 further includes a lenticular body 20, positioned so as to close the containment seat 12 and suitable to be crossed by the beam of light produced by the light source 16 in such a way that the beam of light may be propagated towards the outside of the lighting and/or signalling device 4, passing through the lenticular body 20, at least in a longitudinal direction X-X of propagation of the beam of light, The lenticular body 20 is made of at least partially transparent or semi-transparent or translucent material, and may also include an opaque portion, so as to allow in any case the crossing of the light beam produced by the light source.

The lighting and/or signalling device 4 further includes a first lighting portion 24 delimited by a first optic filter 28 having a first colour.

The colour of the light beam in output, determined by the specific function of the lighting and/or signalling device 4, is different from the colour of the first optical filter 28, as better described below.

By way of example, in the case in which one wishes to obtain a reverse light, the predetermined colour for the signalling/lighting function is white, in the case of an indicator light the predetermined colour is orange, in the case of the sidelights, the predetermined colour is red, and so on.

Apparently the same lighting and/or signalling 4 device can fulfil all the aforementioned functions, and will thus be predisposed to be able to emit, at the various portions of the lenticular body, light beams of predetermined different colours, wherein the different portions of lenticular body, in the configuration of light sources turned off, are not distinguishable from the outside, as described below.

As set forth in one embodiment, the light source 16 is positioned inside the containment seat 12 in a position rearward of the lenticular body 20, in a longitudinal direction X-X of propagation of the beam of light.

Diversely from the known solutions, the light source 16 is facing a light guide 32 which includes a light input wall 36 which receives the beam of light produced by the light source 16, propagates it along a light guide body 40 and emits it from a light output wall 48, facing the lenticular body 20 so that the beam of light crosses the lenticular body 20.

The light output wall 48 is in turn facing the first lighting portion 24 delimited by a first optic filter 28, having a first colour.

Between the light source 16 and the light input wall 36 a second optic filter 52 is positioned having a second colour, different from the first colour of the first optic filter 28 so that the beam of light produced by the light source 16 and filtered by the second and by the first optic filter 52, 28 in succession comes out of the lenticular body 20 having a predefined colour.

As set forth in a further embodiment, the lenticular body 20 includes the first lighting portion 24 provided with the first optical filter 28.

The predetermined colour is obtained by double filtration or subtractive mixing of the light beam produced by the light source 16, through the combined action of the two optical filters 28, 52, separated by a neutral filter element, such as the light guide 32. The light guide 32 thus acts as a separator element of the two optical filters 52, 28 without changing the effect of subtractive synthesis of the two optical filters 52, 28. Because the light guide 32, the second filter 52 is not placed adjacent to the first optical filter 28, as in the prior art, but distant from the latter so as to avoid generating an unwanted colour stimulus with the optical filter 28, in particular along a vehicle axis oriented in the direction of propagation X-X or longitudinal direction towards an outside observer when the light source 16 is turned off.

Only the first optical filter 28 can thus confer the desired colour stimulus along such vehicle axis, when the light source 16 is turned off.

More specifically, the first lighting portion 24 of the lenticular body 20, having a first lighting function, is delimited by a first optic filter 28 having a colour substantially similar or identical to the colour of an adjacent portion 60 of lenticular body 20, having a second different lighting and/or signalling function or cornice function, so that the first optic filter 28 cannot be substantially distinguished, from the outside of the lighting and/or signalling device 4, from the adjacent portion 60 of lenticular body 20. The light guide 32 makes it possible to position the second optical filter 52 in the vicinity of the light source 16 and, thus, in a position hidden from view to an outside observer.

Proceeding in this manner, in the case in which one wishes for example to obtain an indicator light, the first optic filter 28 is a pink colour, the colour of the adjacent portion 60 of lenticular body 20 is red, while the colour of the second optic filter 52 is green and is separated from the first optical filter 28 by the light guide 32 so as to obtain in output from the lenticular body 20 a substantially orange beam of light when the light source 16 is on, and to obtain a lenticular body 20 substantially tending to red, when the light source 16 is off.

Furthermore, it is possible to obtain different combinations of filters in order to obtain lights in output from the lenticular body 20 having different colours.

As set forth in the invention, it is possible to use a lighting and/or signalling device 4 including a container body 8 having a plurality of containment seats 12 each containment seat 12 housing at least one light source 16 electrically connected by electrical connection to power the same, and suitable for emitting a beam of light to propagate to the outside of the lighting and/or signalling device 4.

The lighting and/or signalling device 4 further includes a lenticular body 20, positioned so as to close the plurality of containment seats 12 and suitable to be crossed by the beam of light produced by each light source 16, so that the beam can be propagated towards the outside of the lighting and/or signalling device 4.

The lenticular body 20, at each containment seat 12 includes a first lighting portion 24, used to diffuse a beam of light of a predefined colour, delimited by a first optic filter 28, having a first colour different from the predefined colour, each light source 16 being positioned inside the containment seat 12 in a position rearward of the lenticular body 20, in a longitudinal direction X-X.

Each light source 16 faces a light guide 32 which includes a light input wall 36 which receives the beam of light produced by the light source 16, propagates it along a light guide body 40 and extracts it from the light extraction wall 44, opposite the lenticular body in the direction of propagation X-X, towards the light output wall 48 facing the lenticular body 20 in relation to the direction of propagation X-X.

Between each light source 16 and the light input wall 36 a second optic filter 52 is positioned, having a second colour different from the first colour of the first optic filter 28 so that the beam of light produced by each light source 16 and filtered by the second and by the first optic filter 52, 28 in succession comes out of the lenticular body 20 having the predefined colour, The first optic filters 28 of adjacent portions 60 of lenticular body 20 are the same colour so as to prove substantially indistinguishable when the respective light sources 16 are deactivated.

It should be noted that the adjacent portions 60 of the lenticular body 20 may be in one piece or may be separate portions arranged side by side. Usually the lenticular body 20 is made of a single piece; in any case it is possible to make the lenticular body 20 in several adjacent portions 60 arranged side by side so as to close the respective containment seats 12.

As set forth in one embodiment, the second optic filter 52 is directly applied to the light input wall 36 of the light guide 32.

It is possible to obtain the second optical filter 52 by deposition techniques, in themselves known, such as sputtering, CVD, PVD on the light input wall 36.

As set forth in one embodiment, the second optic filter 52 is associated to a power supply and support strip 56 of the light source 16, so as to position itself between the light source 16 and the light input wall 36.

In particular, the power supply and support strip 56 is a strip for LEDs provided with at least one hole 62, and the second optical filter 52 includes a pin 64 coupled to the hole 62; advantageously the pin 64 is co-moulded with the second optical filter 52 and is inserted into the hole 62 and subsequently hot riveted, so as to create an undercut to its extraction from the hole.

As set forth in one embodiment, the light extraction wall 44 of the light guide 32 has a plurality of extractor elements 68, which extract the light toward the light output wall 48 facing the lenticular body 20.

For example, the extractor elements 68 include extractor prisms shaped so as to extract the light mainly in a longitudinal direction X-X.

As set forth in one embodiment, the lighting and/or signalling device 4 includes a reflective surface 72 facing the light extraction wall 44 and opposite the lenticular body 20, in relation to the light guide 32, the reflective surface 72 reflecting the beam of light towards the lenticular body 20.

In one embodiment, the reflective surface 72 is counter-shaped to the light guide 32.

For example, the reflective surface 72 is obtained by metallisation or by applying mirrors to a support wall 76, or even by the realisation of a white layer, facing the light extraction wall 44 of the light guide 32.

As set forth in one embodiment, the light output wall 48 may include a diffusing surface 80 suitable to evenly distribute the light in output from the light guide 32, for example obtained by satin finishing or embossing.

As set forth in one embodiment, the light output wall 48 may include a diffusing surface 80 having light diffusing elements, for example made by reliefs, grooves, etchings of the light output wall 48 or semi cylindrical optics.

As may be appreciated from the description, the lighting and/or signalling device as set forth in the invention makes it possible to overcome the drawbacks of the prior art.

Indeed, from outside, the vehicle light as set forth in the present invention has a lenticular body having a predetermined colour, substantially uniform, when the light sources are off, it is not possible from the outside to distinguish the different portions of lenticular body used for the various lighting/signalling functions of the light.

From the outside, the observer has the perception of a lenticular body having a substantially uniform colour, because, as shown, the first optical filter gives a uniform colour relative to the adjacent portions of the lenticular body, as desired, when the light source is turned off, since the second filter can be placed away from the first optical filter through the use of a separator element such as the light guide.

It is therefore possible to select the colour of the first filter so that it is uniform and similar to the colour of the adjacent portions of the lenticular body.

Apparently, upon powering of the light sources, the different portions of the lenticular body, because of the subtractive mixing technique achieved through the filters, makes it possible to emit light beams of different colours to perform the specific lighting/signalling functions of the light, such as for example the brake lights, sidelights, indicator lights and reverse lights.

It is thus possible to make lenticular bodies in which the various portions of the light, used for the aforementioned lighting/signalling functions are camouflaged or not easily discernible by an outside observer.

This way the overall appearance of the vehicle light, and the vehicle as a whole, is not affected in any way when the light sources are not powered.

A person skilled in the art may make numerous modifications and variations to the lighting and/or signalling devices described above so as to satisfy contingent and specific requirements while remaining within the sphere of protection of the invention as defined by the following claims.

What is claimed is:

1. A lighting and/or signalling device comprising:

a container body having a plurality of containment seats, each containment seat housing at least one light source electrically connected by electrical connection to power the same, and suitable for emitting a beam of light to propagate to the outside of the lighting and/or signalling device, a lenticular body, positioned so as to close the plurality of containment seats and suitable to receive the beam of light produced by each light source and to propagate it towards the outside of the lighting and/or signalling device, at least in a longitudinal direction of propagation of the beam of light, wherein the lenticular body, at each containment seat includes a first lighting portion, to diffuse a beam of light of a predefined colour, delimited by a first optic filter, having a first colour different from said predefined colour, each light source being positioned inside the containment seat in a position rearward of the lenticular body, in a longitudinal direction of propagation of the beam of light, each light source facing a light guide which includes a light input wall which receives the beam of light produced by the light source, propagates it along a light guide body and emits it from a light output wall, facing the lenticular body so that the beam of light crosses the lenticular body, wherein a second optic filter is positioned between each light source and the light input wall, having a second colour different from the first colour of the first optic filter so that the beam of light produced by each light source and filtered by the second and by the first optic filter in succession comes out of the lenticular body having said predefined colour, wherein the first optic filters of adjacent portions of lenticular body are the same colour such that they are substantially indistinguishable when the respective light sources are deactivated, wherein the second optic filter is associated with a power supply and support strip of the light source, so as to position itself between the light source and the light input wall of the light guide.

2. The lighting and/or signalling device as set forth in claim 1, wherein the lenticular body includes said first lighting portion fitted with the first optic filter.

3. The lighting and/or signalling device as set forth in claim 1, wherein the second optic filter is directly applied to the light input wall of the light guide.

4. The lighting and/or signalling device as set forth in claim 1, wherein the light guide includes a light extraction wall fitted with a plurality of light extraction elements, which extract the light towards the light output wall facing the lenticular body.

5. The lighting and/or signalling device as set forth in claim 4, wherein said extractor elements include extractor prisms shaped so as to extract the light mainly in a longitudinal direction.

6. The lighting and/or signalling device as set forth in claim 1, wherein the lighting and/or signalling device includes a reflective surface facing the light extraction wall and opposite the lenticular body, in relation to the light guide, said reflective surface reflecting the beam of light towards the lenticular body.

7. The lighting and/or signalling device as set forth in claim 6, wherein the reflective surface is counter-shaped to the light guide.

8. The lighting and/or signalling device as set forth in claim 6, wherein the reflective surface is obtained by metallisation or by applying mirrors to a support wall, or by the realisation of a white layer, facing the light extraction wall of the light guide.

9. The lighting and/or signalling device as set forth in claim 1, wherein the light output wall includes a diffuser surface suitable to evenly diffuse the light in output from the light guide.

10. The lighting and/or signalling device as set forth in claim 1, wherein the diffuser surface of the light output wall includes light diffusion elements such as glazing, embossing.

11. The lighting and/or signalling device as set forth in claim 1, wherein said diffuser surface of the light output wall includes light diffusion elements such as projections, grooves, incisions of said light output wall or semi-cylindrical optics.

12. The lighting and/or signalling device as set forth in claim 1, wherein the first lighting portion of the lenticular body, having a first lighting function, is delimited by a first optic filter having a colour substantially similar or identical to the colour of an adjacent portion of lenticular body, having a second different lighting and/or signalling function, so that the first optic filter cannot be substantially distinguished, from the outside of the lighting and/or signalling device, from the adjacent portion of lenticular body.

13. The lighting and/or signalling device as set forth in claim 1, wherein the first optic filter is a pink colour, the colour of the adjacent portion of lenticular body is red, the colour of the second optic filter is green so as to obtain in output from the lenticular body a substantially orange beam of light when the light source is on, and to obtain a lenticular body substantially tending to red, when the light source is off.

14. A lighting and/or signalling device comprising:

a container body having a plurality of containment seats, each containment seat housing at least one light source electrically connected by electrical connection to power the same, and suitable for emitting a beam of light to propagate to the outside of the lighting and/or signalling device, a lenticular body, positioned so as to close the plurality of containment seats and suitable to receive the beam of light produced by each light source and to propagate it towards the outside of the lighting and/or signalling device, at least in a longitudinal direction of propagation of the beam of light, wherein the lenticular body, at each containment seat includes a first lighting portion, to diffuse a beam of light of a predefined colour, delimited by a first optic filter, having a first colour different from said predefined colour, each light source being positioned inside the containment seat in a position rearward of the lenticular body, in a longitudinal direction of propagation of the beam of light, each light source facing a light guide which includes a light input wall which receives the beam of light produced by the light source, propagates it along a light guide body and emits it from a light output wall, facing the lenticular body so that the beam of light crosses the lenticular body, wherein a second optic filter is positioned between each light source and the light input wall, having a second colour different from the first colour of the first optic filter so that the beam of light produced by each light source and filtered by the second and by the first optic filter in succession comes out of the lenticular body having said predefined colour, wherein the first optic filters of adjacent portions of lenticular body are the same colour such that they are substantially indistinguishable when the respective light sources are deactivated, and wherein the second optic filter is obtained by deposition techniques selected from a group including one of sputtering, CVD, and PVD on said light input wall.

* * * * *